US007996111B2

(12) United States Patent
Cheng et al.

(10) Patent No.: US 7,996,111 B2
(45) Date of Patent: Aug. 9, 2011

(54) ROBOTIC DEVICE

(75) Inventors: Hua-Dong Cheng, Shenzhen (CN); Han-Che Wang, Shenzhen (CN); Xiao-Guang Li, Shenzhen (CN); Tsu-Li Chiang, Shenzhen (CN); Kuan-Hong Hsieh, Shenzhen (CN)

(73) Assignees: Ensky Technology (Shenzhen) Co., Ltd., Shenzhen, Guangdong Province (CN); Ensky Technology Co., Ltd., New Taipei, Taiwan (TW)

( * ) Notice: Subject to any disclaimer, the term of this patent is extended or adjusted under 35 U.S.C. 154(b) by 872 days.

(21) Appl. No.: 11/970,535

(22) Filed: Jan. 8, 2008

(65) Prior Publication Data

US 2008/0167751 A1 Jul. 10, 2008

(30) Foreign Application Priority Data

Jan. 8, 2007 (CN) ..... 2007 1 0200014

(51) Int. Cl.
*G05B 19/04* (2006.01)
*A63H 9/00* (2006.01)

(52) U.S. Cl. ..... 700/249; 318/568.16; 446/330; 901/46; 901/50

(58) Field of Classification Search ..... 700/249; 446/91
See application file for complete search history.

(56) References Cited

U.S. PATENT DOCUMENTS 4,438,434 A * 3/1984 Wason ..... 710/107
5,055,755 A * 10/1991 Ozawa et al. ..... 318/568.11
5,743,010 A * 4/1998 Zaguskin et al. ..... 29/857
6,137,375 A * 10/2000 Li ..... 331/175
6,206,745 B1 * 3/2001 Gabai et al. ..... 446/91
6,522,096 B1 * 2/2003 Roth ..... 310/156.01
6,567,724 B2 * 5/2003 Yamamoto ..... 700/261
6,695,672 B1 * 2/2004 Rehkemper et al. ..... 446/298
6,773,322 B2 * 8/2004 Gabai et al. ..... 446/91
6,999,851 B2 * 2/2006 Kato et al. ..... 700/245
7,061,200 B2 * 6/2006 Iribe ..... 318/568.16
7,062,356 B2 6/2006 Takamura
7,695,341 B1 * 4/2010 Maddocks et al. ..... 446/330
2004/0133311 A1 * 7/2004 Park et al. ..... 700/245
2004/0164697 A1 * 8/2004 Iribe ..... 318/568.12

* cited by examiner

*Primary Examiner* — Thomas Black
*Assistant Examiner* — Lin B Olsen
(74) *Attorney, Agent, or Firm* — Winston Hsu; Scott Margo

(57) ABSTRACT

A robotic device in accordance with a plurality of embodiments is provided. The robotic device generally includes a plurality of groups of sensing devices for sensing environmental events; a plurality of controllers for recognizing the environmental events and generating corresponding commands; a plurality of driving devices for driving the robotic device to respond to the environmental events under control of the commands; at least one communication line for communication between the controllers; at least one power line for transmitting power to the sensing devices, the controllers and the driving devices; a plurality of ground lines; a plurality of branches extending out from the communication line, the power line and the ground lines; and a plurality of connectors for connecting the controllers to the branches.

19 Claims, 9 Drawing Sheets

ROBOTIC DEVICE

BACKGROUND

1. Technical Field

The present invention relates to robots, and particularly to a circuit arrangement of a robot.

2. General Background

Robots are used for industrial applications and for entertainment. Robots are designed in a variety of shapes, such as human or animal shaped or other appropriate shape suitable for its job function. But whatever shape a robot is the parts of a robot generally includes sensors, controllers and drivers. These sensors, controllers and drivers are usually interconnected by wires, and the drivers are capable of driving the robots in response to events sensed by the sensors. Commonly, the numbers of sensors, drivers or even controllers will increase with increasing precision of functionality of the robot. This results in an increase in the number of wires used to connect the sensors, derivers and controllers. Eventually, the robot design becomes more complex.

Obviously, as the wiring becomes more complex and more wires are used, the weight of the robot will increase. Further, the resulting complex circuitry may increase the chance of failure of the robot.

Therefore, there is a need for providing a robotic device with a circuit arrangement which can solve the above problems.

SUMMARY

A robotic device is provided. The robotic device includes: a plurality of groups of sensing devices, each sensing device being configured for sensing an environmental event; a plurality of controllers, each controller corresponding to a group of sensing devices and being configured for recognizing the environmental event and generating signals/commands accordingly; a plurality of driving devices being controlled by the signals/commands to drive the robotic device to respond to the environmental event; at least one communication line configured for communication between the plurality of controllers; at least one power line for transmitting power to the sensing devices, the controllers and the driving devices; a plurality of ground lines; a plurality of branches extending out from the communication line, the power line and the ground lines; and a plurality of connectors, each being configured for connecting one of the controllers to the branches. The communication line, power line and the ground lines are arranged along a backbone orientation of the robotic device.

Other advantages and novel features will be drawn from the following detailed description with reference to the attached drawings.

BRIEF DESCRIPTION OF THE DRAWINGS

The components in the drawings are not necessarily drawn to measuring scale, the emphasis instead being placed upon clearly illustrating the principles of the communication device. Moreover, in the drawings, like reference numerals designate corresponding parts throughout the several views.

DETAILED DESCRIPTION OF THE EMBODIMENT

Figure 1:
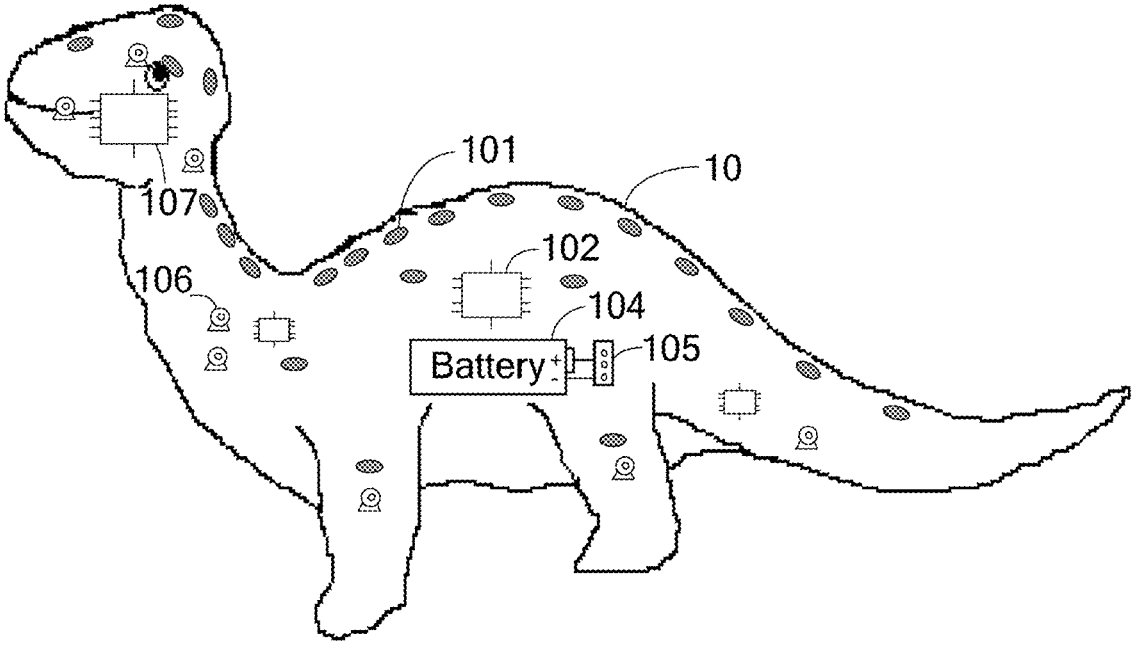
FIG. 1 is a schematic distribution of sensing devices, controlling devices and driving devices within a toy dinosaur.

Referring to FIG. 1, a toy dinosaur 10 is shown as example of robots to illustrate embodiments of the present invention. The toy dinosaur 10 includes a plurality of sensing devices 101 distributed all over or at predetermined positions of the toy dinosaur 10. The sensing devices 101 are allocated under a surface layer of the toy dinosaur 10 and used to sense environmental events. For example, the sensing devices 101 distributed at the eye portion of the toy dinosaur 10 are configured for sensing light, the sensing devices 101 distributed at the ear portion of the toy dinosaur 10 are configured for sensing sounds, and the sensing devices 101 distributed at the back portion of the toy dinosaur 10 are configured for detecting touches from human beings. The sensing devices 101 produce sensing signals and transmit the sensing signals to controllers 102, 107 located inside of the toy dinosaur 10 when certain predetermined environmental events occur. The controllers 102, 107 process the sensing signals and control driving devices 106 which are also located inside of the toy dinosaur 10 to drive the toy dinosaur 10 to respond to the related environmental events.

Generally, according to a preferred embodiment, the sensing devices 101 are divided into a plurality of groups according to locations of the sensing devices 101. For example, sensing devices 101 located at the head portion of the toy dinosaur 10 are included in a "head" group, sensing devices 101 located at the neck portion of the toy dinosaur 10 are included in a "neck" group, and etc. Sensing devices 101 of each of the groups are connected to one of the controllers 102 (slave controllers 102). The slave controllers 102 are preferably located near the related group of sensing devices 101 correspondingly, thus shortening a length of wires connected therebetween. The slave controllers 102 are configured for controlling driving devices 106 which include but are not limited to motors and audio amplifiers. The driving devices 106 are located near body portions of the toy dinosaur 10 that the driving devices 106 are configured to actuate. For example, an audio amplifier, a speaker and a motor used to drive the mouth of the toy dinosaur 10 to open and close are installed near the mouth of the toy dinosaur 10. The mouth opens and closes according to sounds outputted by the speaker so as to imitate that the toy dinosaur 10 is talking.

The slave controllers 102 are connected to the controller 107 (main controller 107). The main controller 107 is configured for coordinating the slave controllers 102 so that the toy dinosaur 10 moves with balance (steadily). By way of example, if the toy dinosaur 10 must shake its head and walk forward to respond to a human touch on its back, the "back" sensing device group produces and transmits the sensing signals to a corresponding slave controller 102 according to the human touch. The slave controller 102 signals the main controller 107 and the main controller 107 coordinates slave controllers 102 that are correspondingly configured to shake the head and drive the toy dinosaur 10 to walk, such that the toy dinosaur 10 will not stumble when walking forward and shaking it's head simultaneously.

A power source 104 such as a battery 104 is also included in the toy dinosaur 10. The battery 104 powers the sensing devices 101, the controllers 102, 107 and the driving devices 106 via a connector 105.

Figure 2:
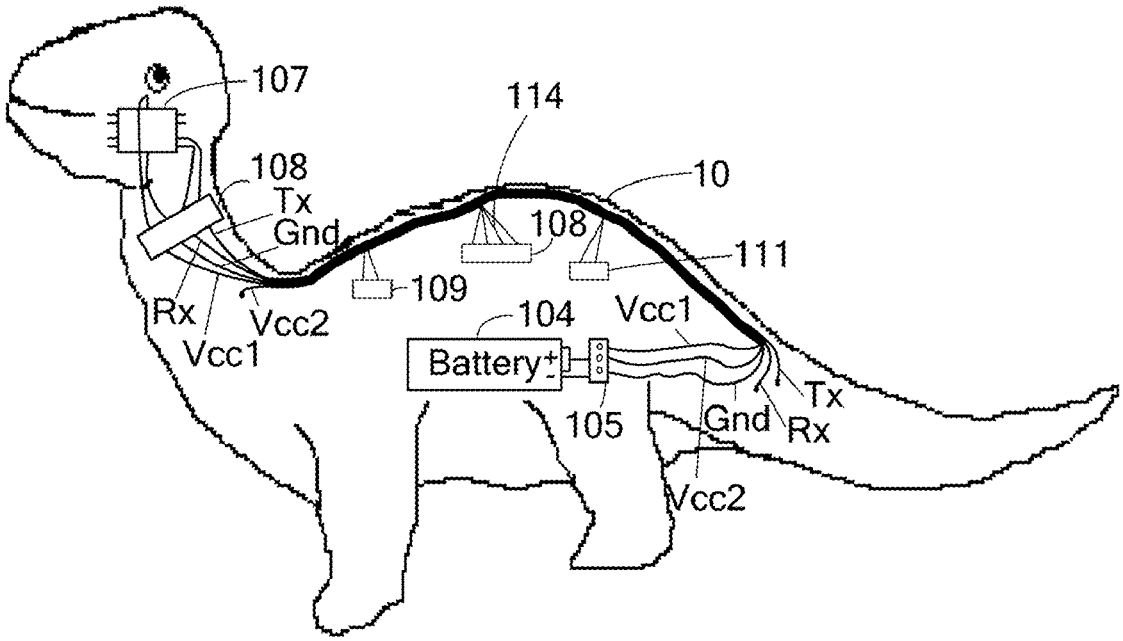
FIG. 2 is a schematic view of power and communication lines used to connecting the sensing devices, controllers and driving devices of FIG. 1 in accordance with a first embodiment of the present invention.

Referring to FIG. 2, a plurality of lines (wires) are used to connect the sensing devices 101, the controllers 102, 107 and the driving devices 106. The lines include communication lines, power lines and ground lines. The communication lines are configured for transmitting signals/commands between the main controller 107 and the slave controllers 102. In the preferred embodiment, the communication lines include a transmission line TX, and a reception line RX. The power lines are configured for transmitting power from the battery 104 to the sensing devices 101, the controllers 102, 107 and the driving devices 106. In the preferred embodiments, the power lines includes two lines, one of the lines (hereinafter referred to as "the power line Vcc1") being configured for transmitting a relatively low voltage and the other of the lines (hereinafter "the power line Vcc2") being configured for transmitting a relatively high voltage. The sensing devices 101, controllers 102, 107 and driving devices 106 are respectively connected to the power line Vcc1 or Vcc2 according to their demand on power to maintain normal operations. In the preferred embodiments, the power line Vcc1 supplies the relatively low voltage used by most of low-voltage devices which may include a plurality of sensing devices 101, controllers 102, 107 and driving devices 106. For example, if a 5V voltage is needed for most of the low-voltage devices, the 5V voltage is supplied via the power line Vcc1 . The power line Vcc2 supplied the relatively high voltage used by most of high-voltage devices which mainly include a plurality of driving devices 106. For example, for most of the high-voltage devices, if a 24V voltage is needed, the 24V voltage is supplied via the power line Vcc2. The relatively low voltage and the relatively high voltage are produced by converting circuits (not shown) that connected between the battery 104 and the power lines. Thus, when the power is conducted to most of the low-voltage devices and high-voltage devices, no further conversion is needed.

The ground lines at least include a power ground line and a signal ground line. In the Figures, the ground lines are collectively labeled as Gnd. The lines (i.e., the ground lines Gnd, the communication lines and the power lines) are fixed under a shell of the toy dinosaur 10 and arranged along a backbone orientation of the toy dinosaur 10. A plurality of branches 114 extend out from the lines and each of the branches 114 connects with a connector. In FIG. 2, only connectors 108, 109, and 111 are exemplarily shown.

Figure 3:
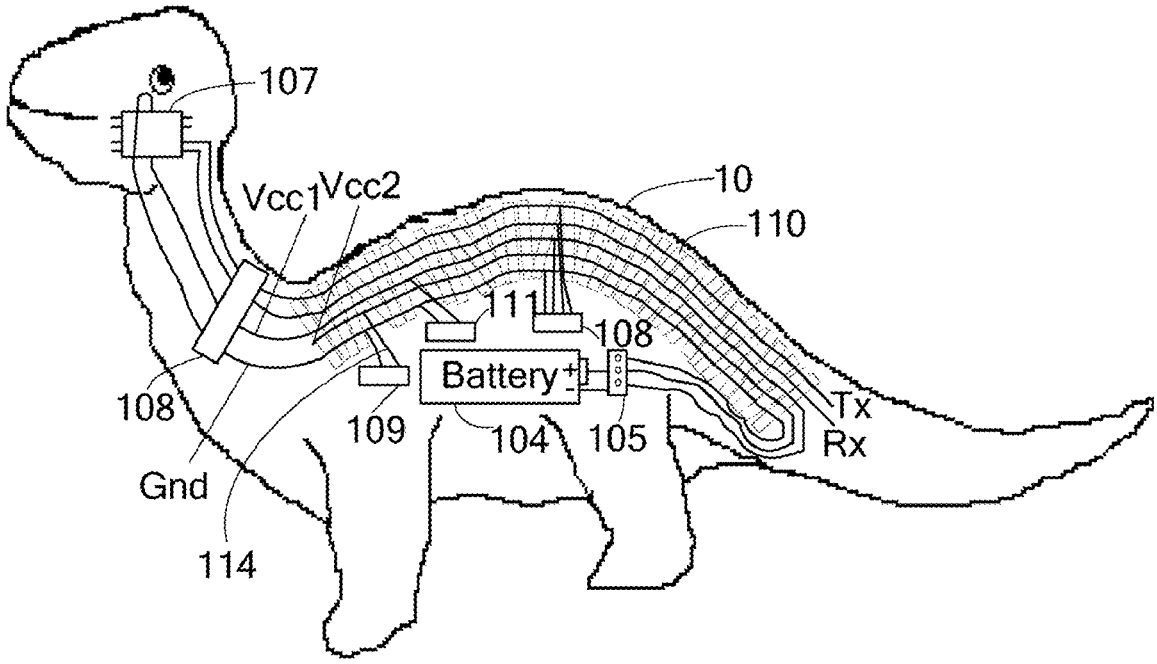
FIG. 3 is schematic view of power and communication lines used to connecting the sensing devices, controllers and driving devices of FIG. 1 in accordance with a second embodiment of the present invention.

Referring to FIG. 3, in the toy dinosaur 10 a backbone 110 is introduced to fix the lines thereon. The backbone 110 is hollow and allows the lines to pass through. A plurality of openings (not labeled) are defined at the backbone 110 and allow the branches 114 of the lines to pass through and then connect to the connectors 108, 109 and 111.

Figure 4:
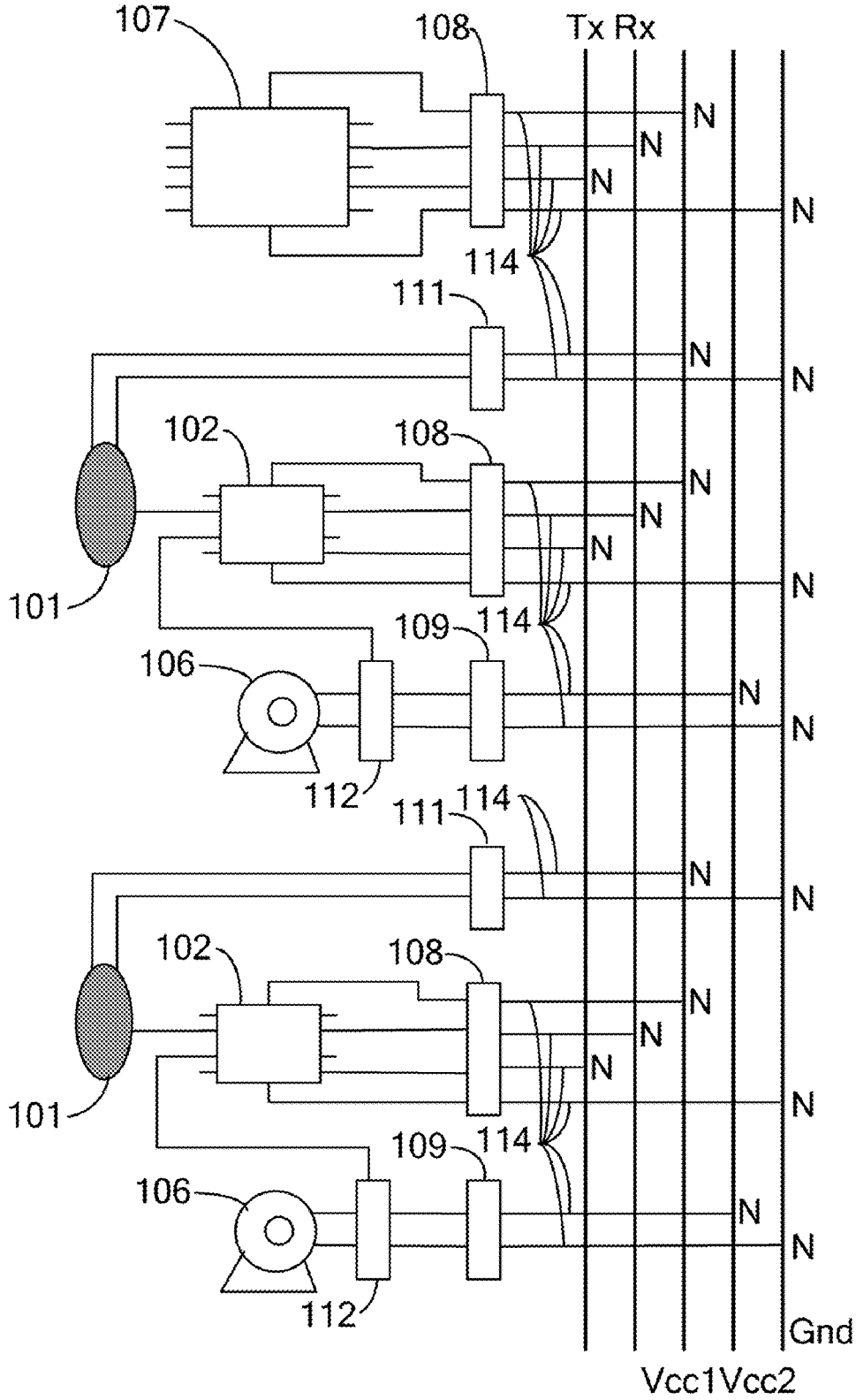
FIG. 4 is a schematic diagram of a first circuit arrangement of the sensing devices, controllers and driving devices of FIG. 1.
Figure 5:
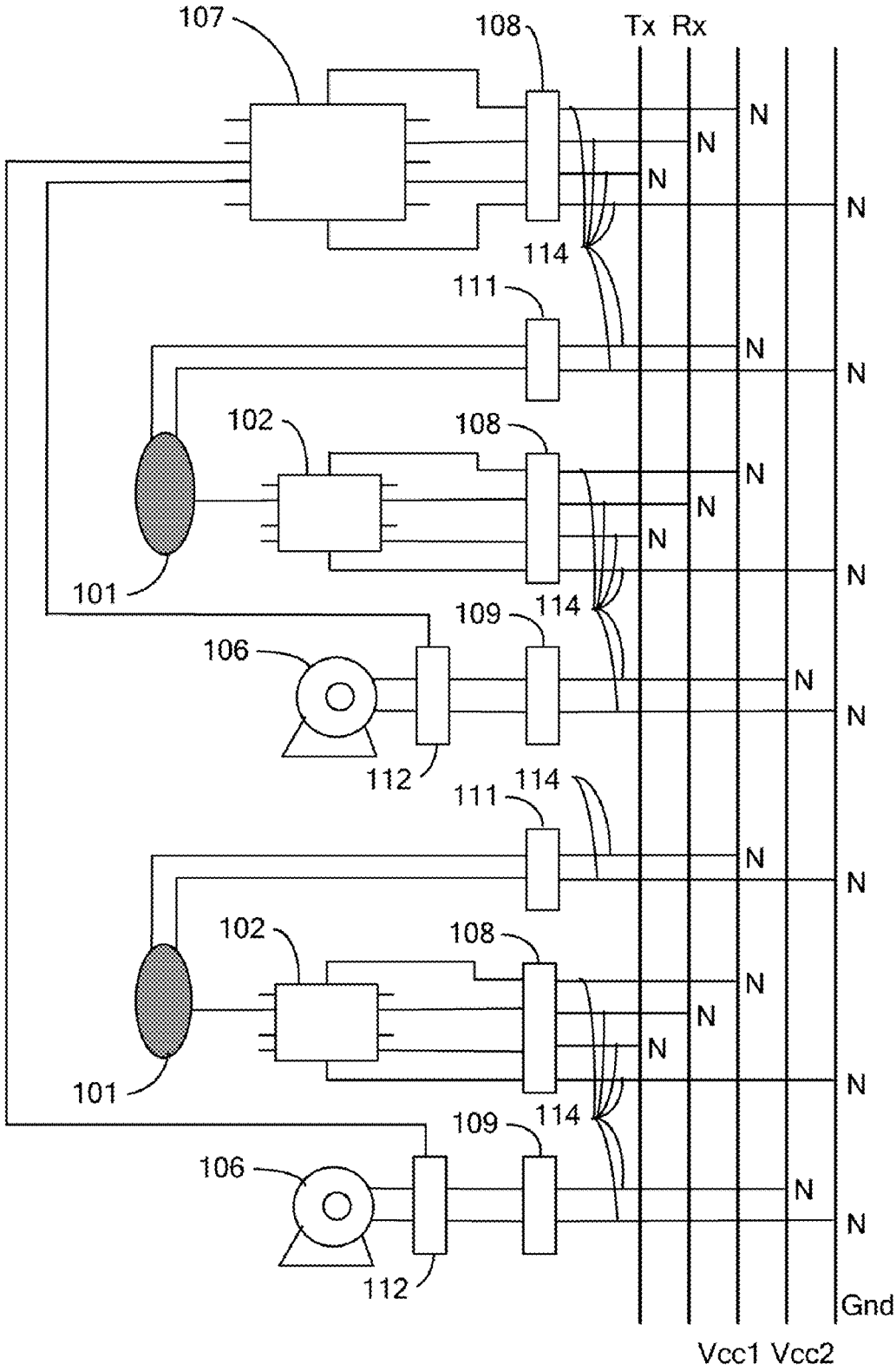
FIG. 5 is a schematic diagram of a second circuit arrangement of the sensing devices, controllers and driving devices of FIG. 1.

Referring to FIGS. 4 and 5, FIG. 4 shows a first circuit arrangement and FIG. 5 shows a second circuit arrangement of the sensing devices 101, the controllers 102, 107 and the driving devices 106. On the lines a plurality of nodes N are defined and the 114 branches of the lines extend from the lines at the nodes N. The 114 branches connect to the connectors 108, 109, 111 correspondingly, and the connectors 108, 109 and 111 then connect to the controllers 102, 107, the driving devices 106 and the sensing devices 101 correspondingly. In depth, the main controller 107 and the slave controllers 102 are connected to the connectors 108 which are subsequently connected to the communication lines TX and RX, the power line Vcc1 and the ground lines Gnd. The sensing devices 101 are connected to the connectors 111 and the connectors 111 are subsequently connected to the power line Vcc1 and the ground lines Gnd. The sensing devices 101 are further connected to the slave controllers 102. The driving devices 106 are connected to the connectors 109 via switches 112 and the connectors 109 are subsequently connected to the power line Vcc2 and the ground lines Gnd. The switches 112 are used to enable/disable the driving devices 106. In the first circuit arrangement, the switches 112 are controlled by the slave controllers 102 as shown in FIG. 4, and in the second circuit arrangement, the switches 112 are controlled by the main controller 107 as shown in FIG. 5.

According to the first circuit arrangement, the sensing devices 101 sense environmental events and transmit sensing signals to the slave controllers 102. The slave controllers 102 recognize the environmental events and enable or disable the driving devices 106 with the switches 112. The driving devices 106 drive the toy dinosaur 10 to move or speak, as if the toy dinosaur 10 is responding to the environmental events. In case where the toy dinosaur 10 must do two or more actions to respond to an environmental event, for example, if the toy dinosaur 10 must walks as well as wags its tail to respond to a human touch to its tail, a slave controller 102 that corresponds to a "tail" group of the sensing devices 101 (i.e., a "tail" slave controller 102) controls a driving device 106 that is configured for controlling the tail (i.e., a "tail" driving device 106) to wag the tail once recognize the touch. The "tail" slave controller 102 also signals the main controller 107 via the communication lines. The main controller 107 transmits commands to a slave controller 102 that is configured for controlling the legs (i.e., a "leg" slave controller 102). The "leg" slave controller 102 controls two driving devices 106 (i.e., two "leg" driving devices 106) to drive the toy dinosaur 10 to move. The main controller 107 also coordinates the slave controllers' control applied to the driving devices 106, such that the toy dinosaur 10 won't stumbles. The signals/commands carried by the communication lines include a tag which indicates to which device the signals/commands are transmitted, thus enabling the signals/commands to be obtained by the right device.

In the second embodiment, a slave controller 102 signals the main controller 107 once an environmental event is recognized. The main controller 107 accordingly controls the toy dinosaur 10 to respond to the environmental event.

Figure 6:
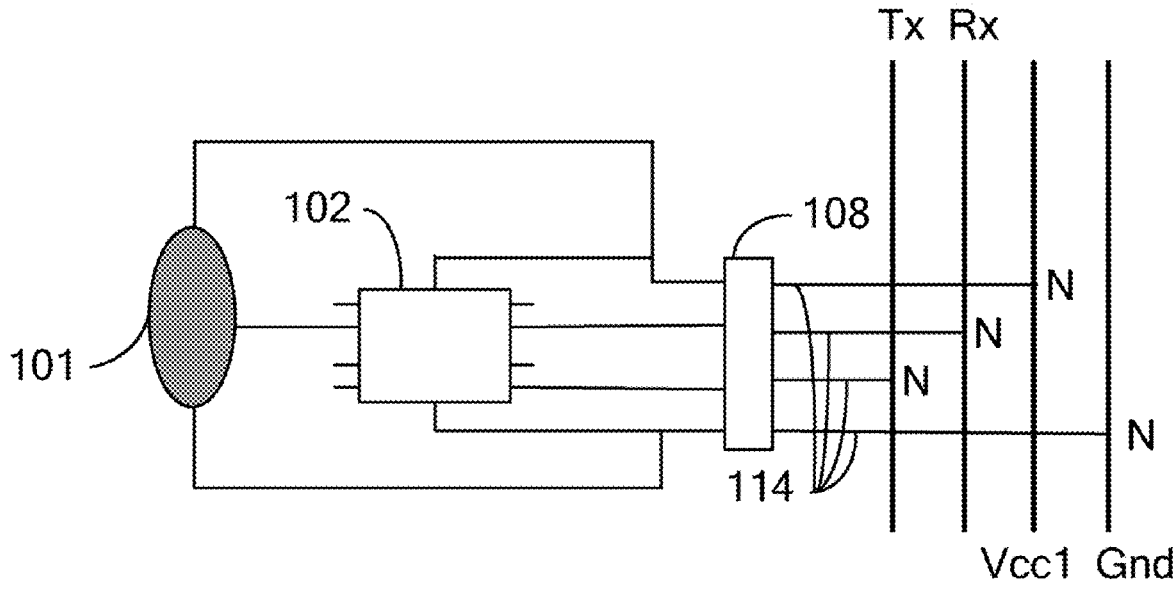
FIG. 6 is a fragmentary schematic diagram of a third circuit arrangement of the sensing devices, controllers and driving devices of FIG. 1.

Referring to FIG. 6, a third circuit arrangement is partly and exemplarily shown. In the third circuit arrangement, elements and connections therebetween which can be duplicated from the foregoing circuit arrangements are omitted from FIG. 6 and relative descriptions are avoided hereinbelow. In the third circuit arrangement, the sensing devices 102 are connected to the power line Vcc1 and the ground lines Gnd via the connectors 108. Namely, the sensing devices 101 share the connectors 108 with their corresponding slave controllers 102.

Figure 7:
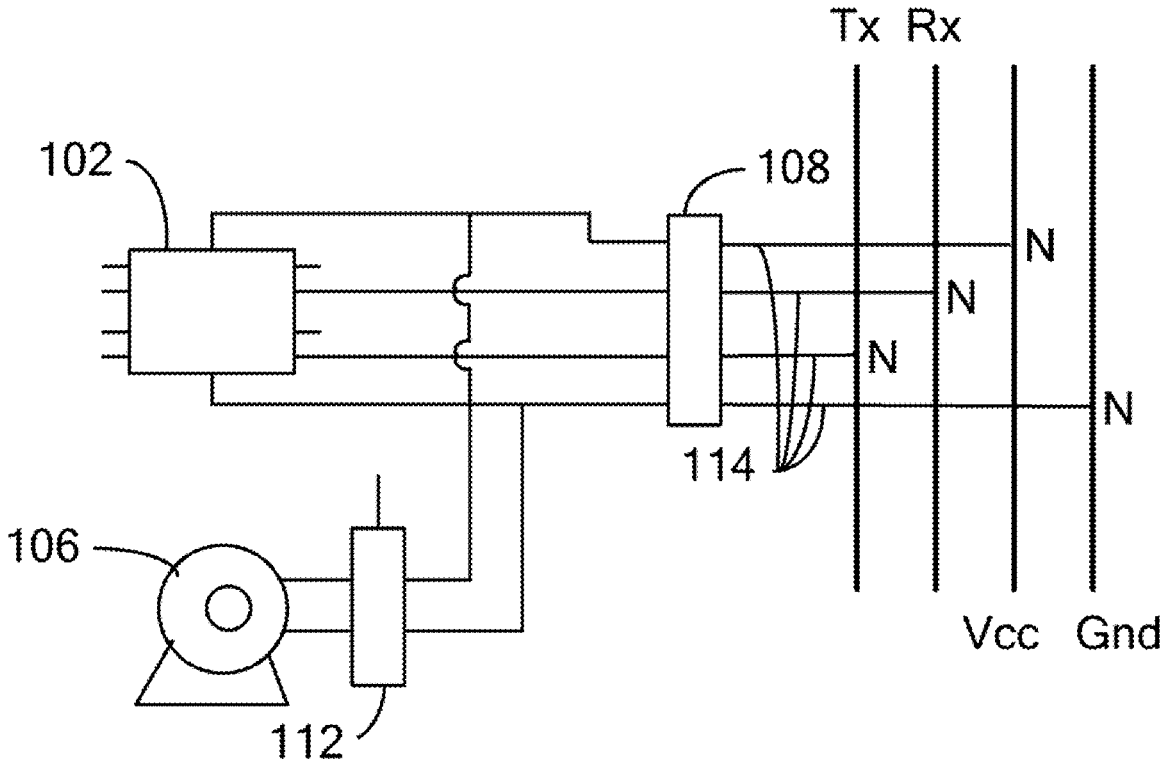
FIG. 7 is a fragmentary schematic diagram of a forth circuit arrangement of the sensing devices, controllers and driving devices of FIG. 1.

Referring to FIG. 7, a forth circuit arrangement is partly and exemplarily shown. In the forth circuit arrangement, elements and connections therebetween which can be duplicated from the foregoing circuit arrangements are omitted from FIG. 7 and relative descriptions are avoided hereinbelow. In the forth circuit arrangement, a single power line Vcc is employed to supply power to the sensing devices 101, the controllers 102,107 and the driving devices 106. The switches 112 are connected to the power line Vcc and the ground lines GND (i.e., the power ground line) via the connectors 108. Namely, the driving devices 106 share the connectors 108 with the slave controllers 102.

Figure 8:
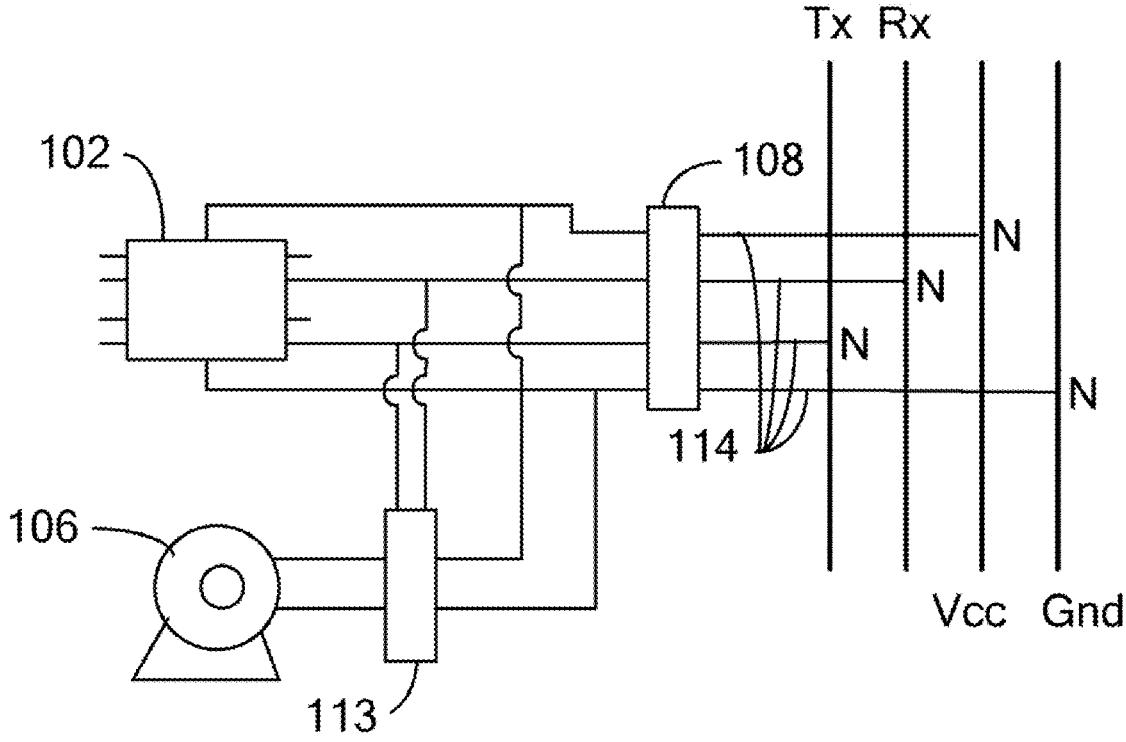
FIG. 8 is a fragmentary schematic diagram of a fifth circuit arrangement of the sensing devices, controllers and driving devices of FIG. 1.

Referring to FIG. 8, a fifth circuit arrangement is partly and exemplarily shown. In the fifth circuit arrangement, elements and connections therebetween which can be duplicated from the forgoing circuit arrangements are omitted from FIG. 8 and relative descriptions are avoided hereinbelow. In the fifth circuit embodiment, a plurality of intelligent switches 113 are employed to replace the switches 112 to enable/disable the driving devices 106. The intelligent switches 113 are connected to the communication lines, the power line Vcc and the ground lines GND via the connectors 108. Namely, the driving devices 106 share the connectors 108 with the slave controllers 102. The intelligent switches receive commands from the main controller 107 or from their corresponding slave controllers 102 and control power supply to the driving devices 106 accordingly.

Figure 9:
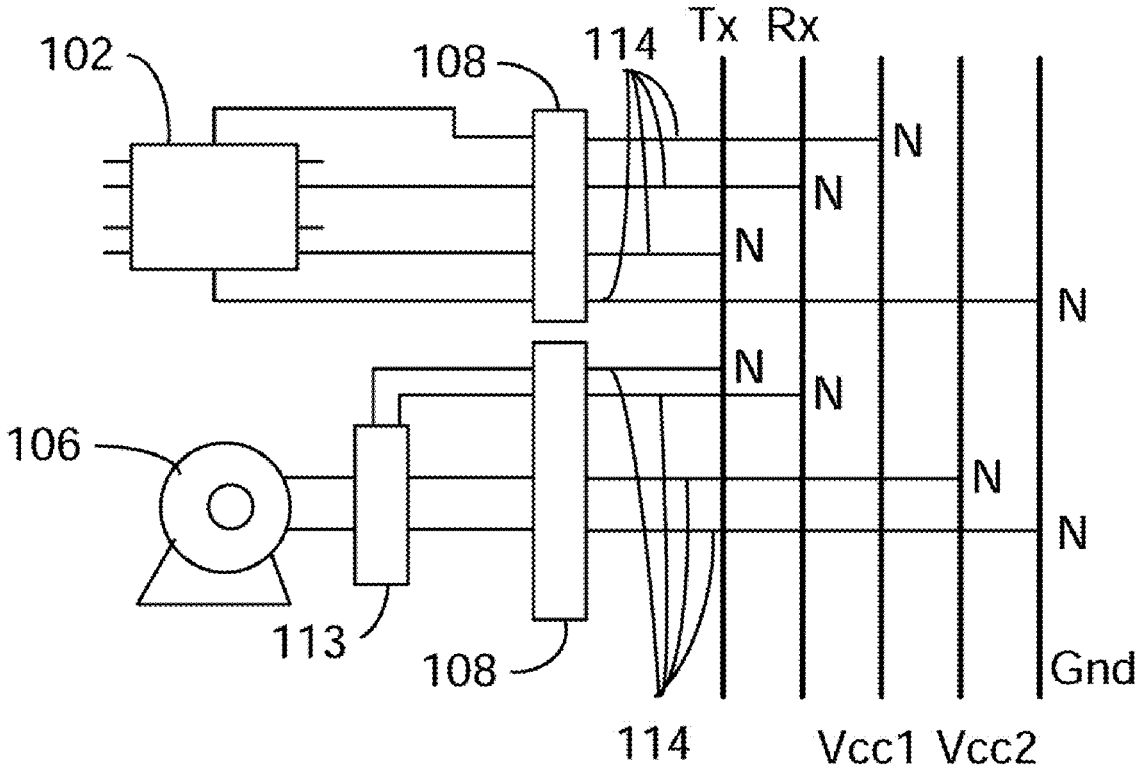
FIG. 9 is a fragmentary schematic diagram of a sixth circuit arrangement of the sensing devices, controllers and driving devices of FIG. 1.

Referring to FIG. 9, a sixth circuit arrangement is partly and exemplarily shown. In the sixth circuit arrangement, elements and connections therebetween which can be duplicated from the foregoing circuit arrangements are omitted from FIG. 9 and relative descriptions are avoided hereinbelow. In the sixth circuit arrangement, the slave controllers 102 and the intelligent switches 113 are connected to the lines via corresponding connectors 108. The slave controllers 102 are connected to the communication lines, the power line Vcc1 and the ground lines Gnd via a plurality of connectors 108 and the intelligent switches 113 are connected to the communication lines, the power line Vcc2 and the ground lines via another plurality of connectors 108.

Embodiments described above all include the main controller 107 to coordinates the slave controller's control to the driving devices 106. However it must be noted that under some situations the main controller 107 can be omitted and the slave controllers 102 intercommunicate to coordinates their control to the driving devices 106.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A robotic device, comprising:

a plurality of groups of sensing devices, each sensing device being configured for sensing an environmental event;

a plurality of controllers, each controller corresponding to a group of sensing devices and being configured for recognizing the environmental event and generating signals/commands accordingly;

a plurality of driving devices being controlled by the signals/commands to drive the robotic device to respond to the environmental event;

at least one communication line configured for communication between the plurality of controllers;

at least one power line for transmitting power to the sensing devices, the controllers and the driving devices;

a plurality of ground lines;

a plurality of branches extending out from the at least one communication line, the at least one power line and the ground lines; and a plurality of connectors, each being configured for connecting one of the controllers to the branches.

2. The robotic device as claimed in claim 1, wherein the at least one communication line, the at least one power line and the ground lines are arranged along a backbone orientation of the robotic device.

3. The robotic device as claimed in claim 1, wherein the connectors are further configured for connecting the sensing devices or the driving devices to the branches extending out from the at least one power line and the ground lines.

4. The robotic device as claimed in claim 1, wherein the connectors are further configured for connecting the driving devices to the branches extending out from the at least one power line, the ground lines and the at least one communication line.

5. The robotic device as claimed in claim 4, further comprising a plurality of switches or intelligent switches configured for connecting/disconnecting the driving devices to/from the connectors according to the signals/commands.

6. The robotic device as claimed in claim 1, further comprising another plurality of connectors for connecting the sensing devices or the driving devices to the branches extending out from the at least one power line and the ground lines.

7. The robotic device as claimed in claim 1, further comprising another plurality of connectors for connecting the driving devices to the branches extending out from the at least one power line, the ground lines and the at least one communication line.

8. The robotic device as claimed in claim 7, further comprising a plurality of switches or intelligent switches configured for connecting/disconnecting the driving devices to/from the another plurality of connectors according to the signals/commands.

9. A robotic device, comprising:

a plurality of groups of sensing devices, each sensing device being configured for sensing an environmental event;

a plurality of slave controllers, each slave controller corresponding to a group of sensing devices and being configured for recognizing the environmental event and generating signals/commands accordingly;

a main controller configured for receiving the signals/commands from the slave controllers and generating commands accordingly;

a plurality of driving devices being controlled by the signals/commands from the slave controllers or the main controller to drive the robotic device to respond to the environmental event;

at least one communication line configured for communication between the plurality of slave controllers and the main controller;

at least one power line for transmitting power to the sensing devices, the main controller and the slave controllers and the driving devices;

a plurality of ground lines;

a plurality of branches extending out from the at least one communication line, the at least one power line and the ground lines; and a plurality of connectors, each being configured for connecting one of the slave controller or the main controller to the branches.

10. The robotic device as claimed in claim 9, wherein the at least one communication line, the at least one power line and the ground lines are arranged along a backbone orientation of the robotic device.

11. The robotic device as claimed in claim 9, wherein the main controller generates the signals/commands to control the slave controllers.

12. The robotic device as claimed in claim 9, wherein the connectors are further configured for connecting the sensing devices or the driving devices to the branches extending out from the at least one power line and the ground lines.

13. The robotic device as claimed in claim 9, wherein the connectors are further configured for connecting the driving devices to the branches extending out from the at least one power line, the ground lines and the at least one communication line.

14. The robotic device as claimed in claim 13, further comprising a plurality of switches or intelligent switches configured for connecting/disconnecting the driving devices to/from the connectors.

15. The robotic device as claimed in claim 9, further comprising another plurality of connectors for connecting the sensing devices or the driving devices to the branches extending out from the at least one power line and the ground lines.

16. The robotic device as claimed in claim 9, further comprising another plurality of connectors for connecting the driving devices to the branches extending out from the at least one power line, the ground lines and the at least one communication line.

17. The robotic device as claimed in claim 16, further comprising a plurality of switches or intelligent switches configured for connecting/disconnecting the driving devices to/from the another plurality of connectors according to the signals/commands.

18. A robotic device, comprising:

at least one communication line configured for communication between a plurality of controllers, the at least one communication line being arranged along a backbone orientation of the robotic device;

at least one power line for supplying power to the controllers, and a plurality of sensing devices and driving devices, the at least one power line being arranged along the backbone orientation of the robotic device;

a plurality of ground lines being arranged along the backbone orientation of the robotic device;

a plurality of branches extending out from the at least one communication line, the at least one power line and the ground lines; and a plurality of connectors connecting with the plurality of branches and be configured for connecting the controllers, the sensing devices and the driving devices to the branches.

19. The robotic device as claimed in claim 18, further comprising a backbone for fixing the at least one communication line, the at least one power line and the ground lines thereon.

* * * * *